United States Patent [19]

Salo

[11] 4,146,346

[45] Mar. 27, 1979

[54] APPARATUS AND METHOD FOR CONTROLLING TIDE WATERS

[76] Inventor: Eric A. Salo, 15898 Via Pinale, San Lorenzo, Calif. 94580

[21] Appl. No.: 809,031

[22] Filed: Jun. 22, 1977

[51] Int. Cl.[2] ..... E02B 3/00; E02B 7/40

[52] U.S. Cl. ..... 405/80; 405/87; 405/88; 405/96; 405/100

[58] Field of Search ..... 61/25, 26, 27, 28, 1, 61/22, 23, 28, 30, 7

[56] References Cited

U.S. PATENT DOCUMENTS

| | | | |
|---|---|---|---|
| 109,899 | 12/1870 | Heath | 61/25 |
| 594,733 | 11/1897 | Fuchs | 61/25 |
| 1,089,232 | 3/1914 | Larson | 61/25 |
| 3,733,830 | 5/1973 | Jacobs | 61/25 X |
| 3,756,032 | 9/1973 | Solinas | 61/25 |

*Primary Examiner*—Jacob Shapiro

[57] ABSTRACT

The salinity intrusion of ocean tidewater into a communicating fresh water river is prevented by laterally restricting the out-flow cross-section of the river with a series of flotation weirs and control weirs so that the surface level of the out-flow cross-section is higher than the surface level of the adjacent tidal salt water. The weirs are located so as to not obstruct the ship channel of the river.

7 Claims, 7 Drawing Figures

10
12
14
16
18
20
22
24
26
38
60
62
64
66
68
70
72
74
76
80
82
86
88
2
3
4
6
7

APPARATUS AND METHOD FOR CONTROLLING TIDE WATERS

SUMMARY OF THE INVENTION

The principal object of the invention is to provide a new way and means to prevent tidal salt water from intrusion up a river.

A further object of the invention is to control river flow into tidal waters by a system of weirs so as to eliminate salt water intrusion into the upstream river without substantial interference with the passage of ships past the weir system.

Other objects and advantages of the invention will be apparent from the following description taken in conjunction with the drawings forming part of this specification, and in which.

DESCRIPTION OF THE INVENTION

Figures 1, 2, 3:
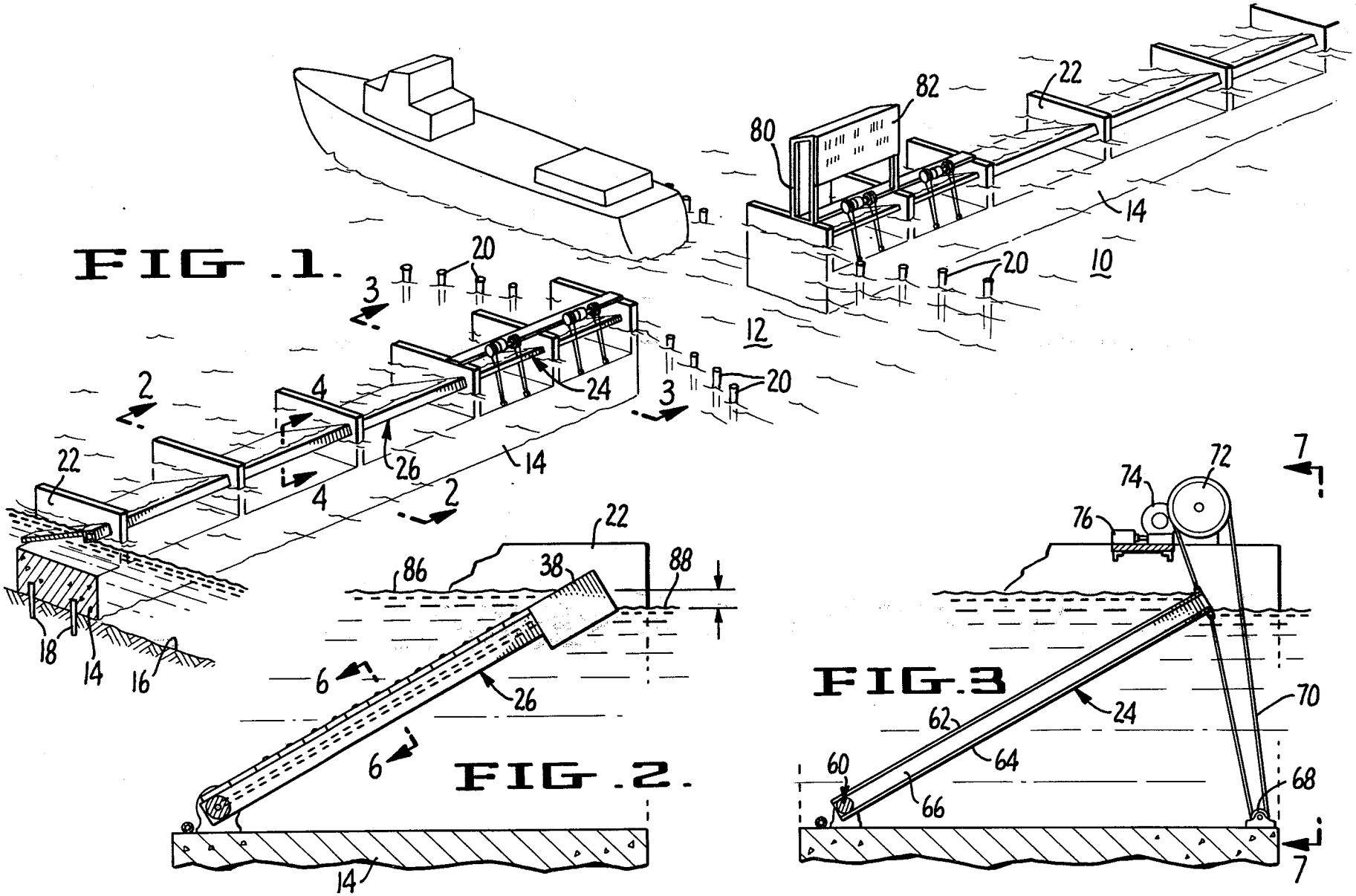
FIG. 1 is a view in perspective of an installation of the weir system of the invention.
FIG. 2 is an enlarged view taken along lines 2—2 of FIG. 1.
FIG. 3 is an enlarged view taken along lines 3—3 of FIG. 1.

With reference to FIG. 1, a river 10 having a ship channel 12 is provided across the full width thereof, except for the ship channel 12 which is left clear and open, with a concrete weir base 14 anchored to the river bed 16 by pilings 18. Pile dolphins are provided to protect the weir works against ship and boat collisions.

Integral with the weir base sections 14 are concrete partition members 22 which extend above the mean high high water level of the river and which also extend below the mean low low water level of the river. Positioned between the partition members or walls 22 are a plurality of control weirs indicated generally at 24 and flotation weirs indicated generally at 26. The control weirs 24 are located adjacent the dredged channel 12 at each side thereof and the flotation weirs 26 occupy the remainder of the width of the river between the control weirs and the river banks.

Figure 6:
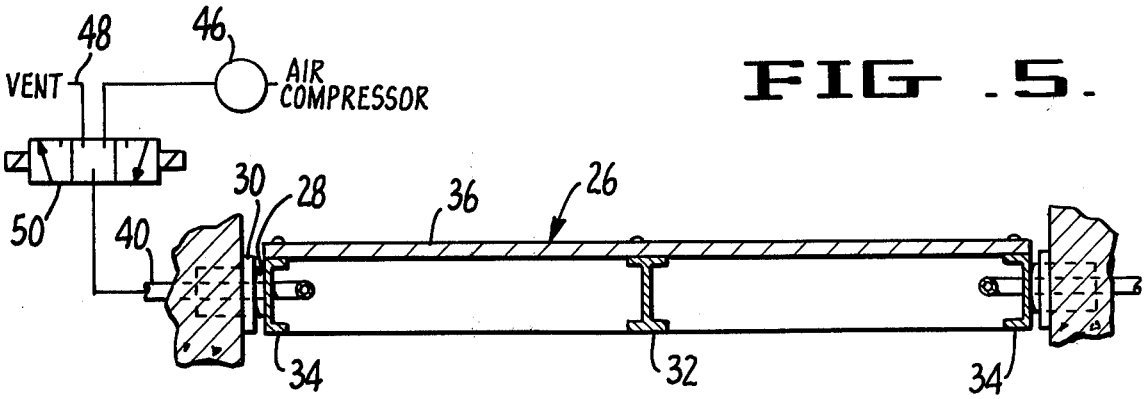
FIG. 6 is a view taken along lines 6—6 of FIG. 2, showing also in a schematic way the air supply and control system for the flotation weirs.
Figure 7:
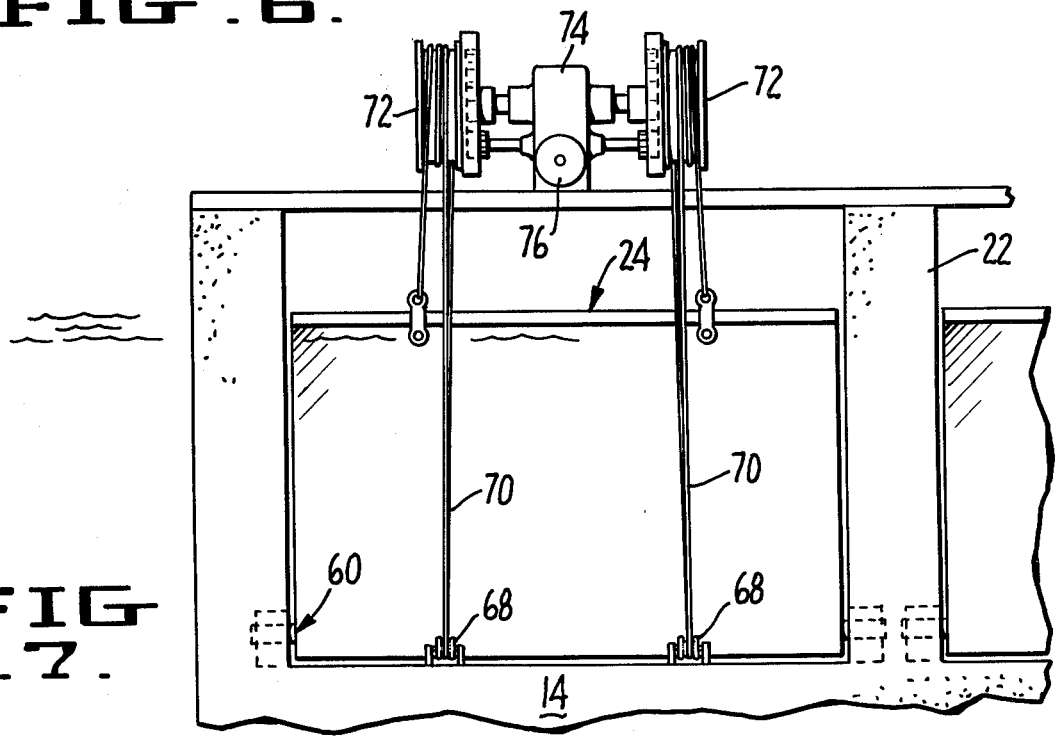
FIG. 7 is a view taken along lines 7—7 of FIG. 3.

The flotation weirs 26 are pivotally attached to wall members 22 by trunnion and trunnion plate connectors 28, 30 (FIG. 6). These weirs 26 are of a light weight construction and are comprised preferably of aluminum I beams 32 and channels 34 and a timber facing 36 on the upstream side. At their free ends, the weirs 26 are provided with flotation members or housings 38 defining therein flotation chambers. The weirs 26 are provided with air inlet lines 40 which extend through the pivot elements 28, 30 and along the undersides of the weir leaves into the flotation members 38 where they terminate in discharge nozzles 42 located closely adjacent the top walls of the float members 38. The system includes an air compressor 46, vent lines 48, and valve control elements 50 (FIG. 6) to selectively connect the compressor 46 to the weir air lines 40 or the vent lines 48. The float members 38 are further provided with water ports 52 and control means therefor comprising a float ball 54 attached to a carrier arm 56 having a pivotal connection with the lower wall 58 of the float member or housing 38.

The control weir leaves 24 comprise trunnion mounting means 60, opposed facing surfaces 62 and 64, and internal support and reinforcement members 66. The control weirs are provided with means for controlling their angular position comprising downhaul sheaves 68, adjusting cables 70, adjusting drum 72, drum drive 74, and motor 76.

The system further includes a control house 80 from which the operation of the individual weirs is controlled and monitored. The control house is provided with a display board 82 which is to be used to communicate suitable instructions to approaching ships and boats to maintain satisfactory traffic control through the channel 12.

Figure 4:
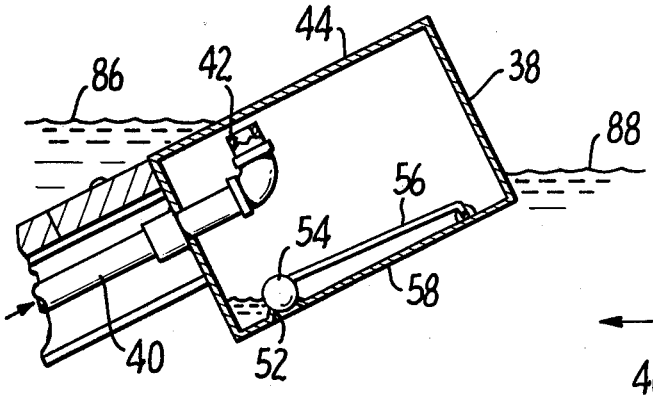
FIG. 4 is an enlarged detail view taken along lines 4—4 of FIG. 1, showing the upper end of a flotation weir in floating position.
Figure 5:
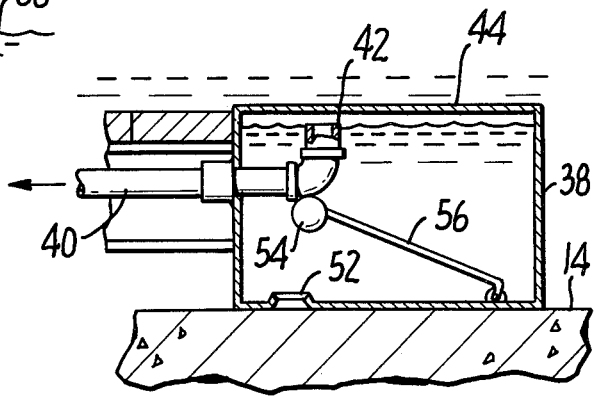
FIG. 5 is a view similar to that of FIG. 4 but showing the upper end of the flotation weir in sunken position.

The operation of the system is as follows. When the tidal flow is outgoing, the weirs 24 and 26 are disposed in the full flow position exemplified by the horizontal position of the weir in FIG. 5. On the turn of the tide, and even before that under conditions of low river flow and spring tides, the flotation weirs 26 are closed or raised sequentially from shoreside to the control weirs 24. This is accomplished by adjustment of the control means 50 to connect the air compressor 46 with the float members 38 through the lines 40. The incoming air forces the water out of the members 38 through ports 52, causing the weirs to raise to the FIG. 4 position and the float balls 54 to be maintained in sealing relation to the ports 52. The idea is to close or raise as many of the flotation weirs sequentially as may be needed to maintain the fresh water level 86 above the sea water level 88 and to maintain a net fresh water outflow in the channel 12. As the tidal inflow increases to a point where the water level downstream of the weir system approaches the upstream level, the control weirs 24 are manipulated through operation of the means 72, 74, 76 to maintain a slight but positive higher level upstream, thereby preventing the intrusive flow of sea water upstream of the weir system. The control weirs 24 are also to be used to modulate the river flow to relieve the channel 12 flow when this is needed to prevent an excessive speed of flow in channel 12, and to prevent excessive level gradient of the water adjacent to the channel 12, thereby minimizing cross-flow that might otherwise cause navigational difficulties.

When the flotation weirs have been raised, the control means 50 are adjusted to the air shut off position shown in FIG. 6 in which the air lines 40 are disconnected from the compressor and the vent lines 48.

When the tidal flow once again becomes outgoing, the flotation weirs are moved to the horizontal or full flow position by selective operation of the control means 50 to connect the weir air lines 40 with the vent lines 48. This allows the float members 38 to fill with water. The weirs 26 move to the horizontal position as this takes place.

The flotation weirs 26 are, as previously stated, of light weight construction in order to properly operate under hydrostatic balance conditions. The control weirs, on the other hand, are of a somewhat heavier and more rugged construction, being designed for differential hydraulic heads of up to 12 inches plus kinetic effects from water flow. These control weirs 24 are precisely positionable by the power driven drum winches 72 with control of both their upward and their downward movement. Low pitch worm gear drives are preferably used to prevent hydraulic forces from shifting the positions of the weir leaves 24. The advantages of this weir control system are many. It prevents the intrusion of downstream ocean water into upstream fresh water; it enables the control of chlorides intrusion without objectionable interference with marine traffic; it provides a very substantial savings in cost over previously proposed dam and ship lock systems; it provides relatively little interference with marine traffic as compared to a system of ship locks for the passage of ships past a fixed dam; it eliminates the problems with brackish water, which are costly to industry, in areas upstream of the location of the weir system; it will enable the restoration in time of the quality of shoreside aquifers which have in the past deteriorated from chlorides intrusion; and its use will eliminate the contaminating effects of sewage and waste waters commonly discharged into tidal waters which presently penetrate miles upstream of rivers upon changes in tide.

What is claimed is:

1. A method of preventing the tidal intrusion of sea water into a fresh water river comprising, at a time of development of an incoming tidal flow, progressively constricting at a predetermined control station the cross-sectional flow area of the river from each shore toward the middle thereof, while preventing water flow therepast in either direction at the upper end of the flow area so constricted, until the outflow level of fresh water in the remaining unconstricted flow area of the river exceeds the opposing level of sea water at said station, maintaining such a disparity in said water levels until the time of development of an outgoing tidal flow, and thereafter progressively unconstricting said cross-sectional flow area in the direction of each shore.

2. A method of preventing the tidal intrusion of sea water into a fresh water river having a ship channel comprising, at times of development of normally incoming tidal flows, progressively constricting at a predetermined control station the cross-sectional flow area of the river from each shore toward said ship channel, while preventing water flow therepast in either direction at the upper end of the flow area so constricted, until the outflow level of fresh water in the remaining unconstricted flow area of the river exceeds the opposing level of sea water at said station, and maintaining such a disparity in said water levels until the time of development of an outgoing tidal flow.

3. A water flow control system for the prevention of the tidal intrusion of sea water into a fresh water river having a generally centrally located dredged ship channel comprising continuous concrete foundational weir gate supports extending from the shores or banks of the river to approximately said channel, a plurality of spaced vertical wall members carried by said supports, said wall members extending parallel to the river, below the mean low low water level and above the mean high high water level, weirs pivotally attached at their lower ends between pairs of said wall members, said weirs being adapted to be raised to block flow between said wall members and to be lowered to unblock flow between said wall members, and means to separately and selectively raise and lower said weirs to flow blocking and flow unblocking positions.

4. The combination of claim 3, said means including flotation members having air chambers therein attached to the upper ends of said weirs, a source of compressed air, conduits to interconnect said source and said chambers, water filling ports in said members and float valve means associated therewith, and control means for each weir to selectively interconnect said source with said chamber to empty said chamber of water, close said valve means and float said weir, to thereafter selectively disconnect said source and said chamber while maintaining the buoyancy condition of said weir, and to thereafter selectively vent said chamber to cause a lowering of the weir to a flow unblocking condition.

5. The combination of claim 4, further including at least one non-flotation weir disposed immediately adjacent said channel at each side thereof, each non-flotation weir being pivotally attached at its lower end between a pair of said wall members, and drive means for each non-flotation weir to positively control the position of the upper end thereof between levels below mean low low water level and above mean high high water level.

6. The combination of claim 5, said drive means including adjusting cables at both ends to the weir, downhaul sheaves therefor, winding drums therefor, a motor, and low pitch worm gear drive transmission interconnecting said motor and drums.

7. A method of preventing the tidal intrusion of sea water into a fresh water river comprising laterally reducing at a control station the flow cross-section of the river from each side of the river to a channel in which the surface level of the fresh water outflow from the river is higher than the adjacent tidal level of sea water, and maintaining said channel open for fresh water outflow while preventing flow past said station of both river water and sea water outside of said channel.

* * * * *